United States Patent [19]

Langer et al.

[11] Patent Number: 4,919,230

[45] Date of Patent: Apr. 24, 1990

[54] SCAFFOLD PLATFORM SECTION

[76] Inventors: Ruth Langer, Im Weinberg 13, D-7129 Güglingen, Fed. Rep. of Germany; Ulrich Layher, Im lailen 16, D-7129 Güglingen-Eibensbach, Fed. Rep. of Germany

[21] Appl. No.: 248,111

[22] Filed: Sep. 23, 1988

[30] Foreign Application Priority Data

Sep. 23, 1987 [DE] Fed. Rep. of Germany ..... 3731945
Sep. 21, 1988 [DE] Fed. Rep. of Germany ..... 3832066

[51] Int. Cl.[5] ..... E04G 1/36; E04G 5/08
[52] U.S. Cl. ..... 182/179; 182/223
[58] Field of Search ..... 182/223, 222, 179, 178, 182/131, 130

[56] References Cited

U.S. PATENT DOCUMENTS 557,501 3/1896 Ennis ..... 182/223
3,250,345 5/1966 Behr ..... 182/223
3,265,156 8/1966 Jacobs ..... 182/223
3,908,793 9/1975 Vaughn ..... 182/223
4,583,618 4/1986 Zimmerman ..... 182/223

*Primary Examiner*—Reinaldo P. Machado
*Attorney, Agent, or Firm*—Antonelli, Terry & Wands

[57] ABSTRACT

A scaffold platform section is fashioned as a corner platform section (117) and exhibits an optionally multipartite floor plate (27) at which at least one supporting leg (29) is bent at an angle, carrying drop-in claws (13) or the like. A supporting leg has a lower lift-preventing leg (30) extending to below the U supporting span member (14) in the drop-in position. This platform section bridges a great variety of different angular regions between other scaffold platforms and can have a swivel member (37) for compensating purposes. The corner platform section (117) proper can be equipped with a border leg (35). The swivel member (37) can have a border leg (38). Two component elements can be joined in a swivelable and inflexible fashion.

17 Claims, 16 Drawing Sheets

SCAFFOLD PLATFORM SECTION

BACKGROUND OF THE INVENTION

The invention relates to a scaffold platform section for bridging small walking and working surfaces that do not have parallel boundaries and, more particularly, to scaffolds composed of several panels, the axis of which are inclined with respect to each other in order to permit a set-up of scaffolding for angled and/or rounded buildings, with the scaffolding comprising a corner platform section supported on supporting span members or the like and/or on adjoining rectangular scaffold platforms.

Scaffolds must be erected, extending around rectangular or skew corners on building and container walls that are rounded or extend in the manner of polygonal routes, on the outside or also in the interior thereof, in order to enable working on the walls, wall surfaces, installations, apparatuses, or the like.

Normal scaffoldings have rectangular scaffold frame platforms suspended in the scaffold by suitable means; however, in corner zones, difficulties are always encountered by a continuous platform and, to date, individual solutions were realized in all cases, by shop-made or custom made corner sections.

It is hardly possible any more to employ wood for such corner structures, especially in view of the danger of fire in case of highly flammable or highly explosive materials, but also in view of an economical erection of the scaffold.

Accordingly, there is a need for scaffold platform sections for bridging small walking and working surfaces which are not parallel and do not exhibit rectangular boundaries.

The aim underlying the present invention essentially resides in providing scaffold platform sections of the above-mentioned type which can be used in present scaffoldings, can be suspended in place with simple means, and are adapted to the respective purpose with a structure that, if at all possible, readily bridges the corner. According to advantageous features of the present invention, a scaffold corner platform section is provided which includes a floor plate unilaterally equipped with a drop-in edge with drop-in means, with the other supporting edge resting on the neighboring scaffold platform and extends in correspondence with the maximally to be covered corner angle. An the outer boundary follows a linear, bent, or rounded route corresponding in the primary usage positions to the positions of the vertical, externally located posts of the adjoining scaffold panels.

By virtue of the fact that a suitable scaffold platform section is equipped with drop-in means and is suspended in place on one side firmly and safe from lift-off, the two remaining important marginal zones can be shaped and supported in correspondence with the respective requirements.

Thus, a simple solution can be realized with identical drop-in means, as in case of more complicated scaffold platform sections, for a specific angular range without exchange parts or unfolding parts, in a fixed structure. Additionally, this solution can be provided with an edge board-like, high-rim margin in order to prevent sliding off of components or persons also in the external zone.

In a further development, above all for relatively large angles of about 90°, it is expedient to provide folding parts bridging the respective residual area.

In this construction, the outermost point of the basic element is located so that, when pivoting about a central point of the respective inner scaffold corner, the part of the external supporting element projecting maximally toward the inside can just barely be swung past the outer corner. The portion to be covered, which in such case is no longer safe with respect to falling, is suitably covered by a residual area folding member which can additionally be equipped with an upturned rim. This residual area folding member is advantageously articulated for pivoting with a vertical pivot pin and is located with a compensating surface thereof below the main surface of the scaffold platform section.

The supporting end, resting on the other rectangular scaffold platform is suitably provided with a downwardly oriented marginal supporting leg, permitting, a secured position of the scaffold platform section and, a stumble-free bridging of transverse elements on scaffolds requiring, due to their frame structure, transverse elements lying on top of the drop-in means of the scaffold platforms. Such a scaffold platform section with stumble-free marginal supporting leg, located at a somewhat higher level, can, however, also be used for scaffolds made for individual elements with jaws, detachable wedges, and perforated mounting disks, because the lift amounts to only a few millimeters. Thus, identical scaffold platform sections can be utilized for different scaffoldings, just as long as the drop-in means are identical on one side. This is the case, in particular, with U-shaped rails open toward the top into which end drop-in means are suspended. In U-shaped rails, lift-preventing legs, simply angled downwards, suitably extend from the bottom therebelow during the inward pivoting step.

In accordance with further advantageous features of the present invention, the provision is made according to the invention that the corner platform section is constituted by two partial floor plate elements individually equipped with a drop-in edge with drop-in means (drop-in claws). The partial floor plate elements come to lie partially in mutual superposition and are pivotable with respect to each other about a center (central point) located at a suitable position with respect to the position of the adjoining scaffold platforms, and are connected in a flexurally rigid manner. This solution according to the invention realizes many of the advantages also recited in conjunction with the first solution. However, due to the flexurally rigid connection, this structure is more complicated, though affording smoothly extending edge board surfaces, due to the drop-in means provided at both edges, even in the corner region and thus avoiding small stumble steps. This structure also has defined supporting points rendering the static conditions readily discernable and clear and permitting small angles as well as large angles for the corner platform section.

In such an arrangement, it is advantageous to give the outer edges of both partial elements the shape of a divided circle. In such a case, they can be more readily pushed into superposition, and offer a clear termination of the entire corner surface up to the railing joining the two neighboring posts.

The flexurally rigid connection can be formed by telescopable guiding edge legs and/or one or several divided circle-slotted hole sliding connections. The guiding edge legs simultaneously constitute the boundary of the edge board and permit a secure, flexurally rigid connection with a large supporting base, forming, with a farther inwardly disposed divided circle-slotted hole, a rugged connection of the two partial elements. However, it is also possible and in some cases practical to provide two divided circle-slotted hole sliding connections, or even a larger number in case of larger elements. In order to design the sliding connection so that it has long term load-bearing ability and yet is readily slidable, it is suitably provided with a guiding edge leg with shaped point-contact protuberances or elevations in the sliding portion. Such elevations do not reduce the ruggedness but rather ensure secure load-bearing ability even under rough operating conditions.

Another sensible measure provides that only one drop-in connection exhibits a lift-preventing leg as it is also described in conjunction with the other described embodiments.

This permits simple drop-in and secure retention against unintended lift-off and tipping over the corner.

The scaffold platform sections of the invention can be equipped with the engaging means fitting the respective scaffolding system. In this connection, suitable are hooks, brackets, claws, talons, and slip-on devices. An advantageous embodiment provides that the respective drop-in edge exhibits, at a distance adapted to the scaffold support, drop-in eyes for mounting retaining pins which are unobstructed in the upward direction. Also, in such arrangements, corner platform sections of the type according to this invention are expedient. In this structure, the drop-in eyes are suitably arranged at a downwardly angled, vertical supporting leg of the corner platform section, no matter whether the latter is of a one-piece or a two-piece construction.

BRIEF DESCRIPTION OF THE DRAWINGS

The above and other objects, features, and advantages of the invention will become more apparent from the following description when taken in connection with the accompanying drawings which show, for the purposes of illustration only, several embodiments in accordance with the present invention, and wherein.

DETAILED DESCRIPTION

Figure 1:
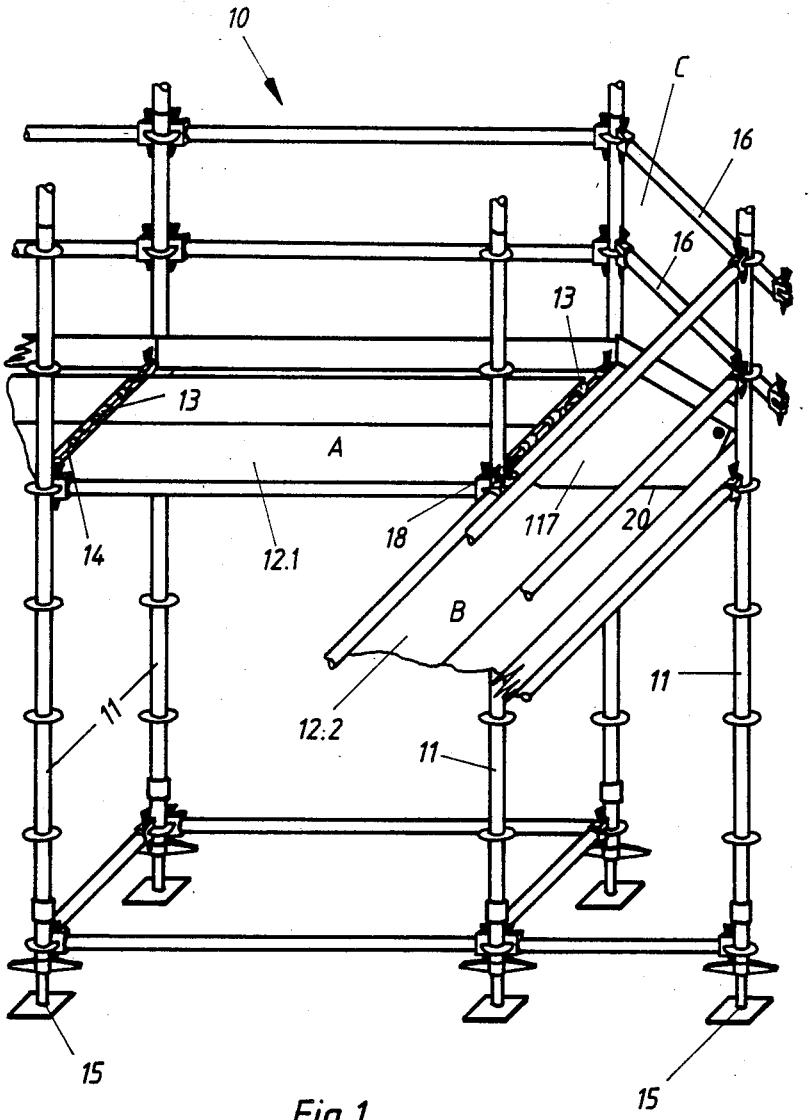
FIG. 1 is an oblique view of a scaffold corner with a corner platform section.

Referring now to the drawings wherein like reference numerals are used throughout the various views to designate like parts and, more particulary, to FIG. 1, according to this figure, a scaffold generally designated by the reference numeral 10 includes a plurality of spaced posts 11 joined by conventional transverse elements, customary corner joints, and railing bars 16. Rectangular scaffold platforms 12.1, 12.2, forming two scaffold panels A, B are suspended, in a conventional manner, by drop in claw means 13 accommodated in upwardly open U-shaped supporting span members 14 extending between adjacent support posts 11, with the posts 11 each being provided with conventional support feet 15.

As shown in FIG. 1, the two scaffold panels A, B are set up at a mutual angle of 90° and are provided in this case, for example, with only one scaffold platform deck. The corner zone C must be bridged and comprises diagonally extending railing bars 16 as well as a corner platform section 117 including along one rim thereof a drop-in edge 18 with drop-in claws 13, by which the corner platforms section 117 is suspended in this marginal zone in the upwardly open U-shaped supporting cross-pieces 14.

Figure 2:
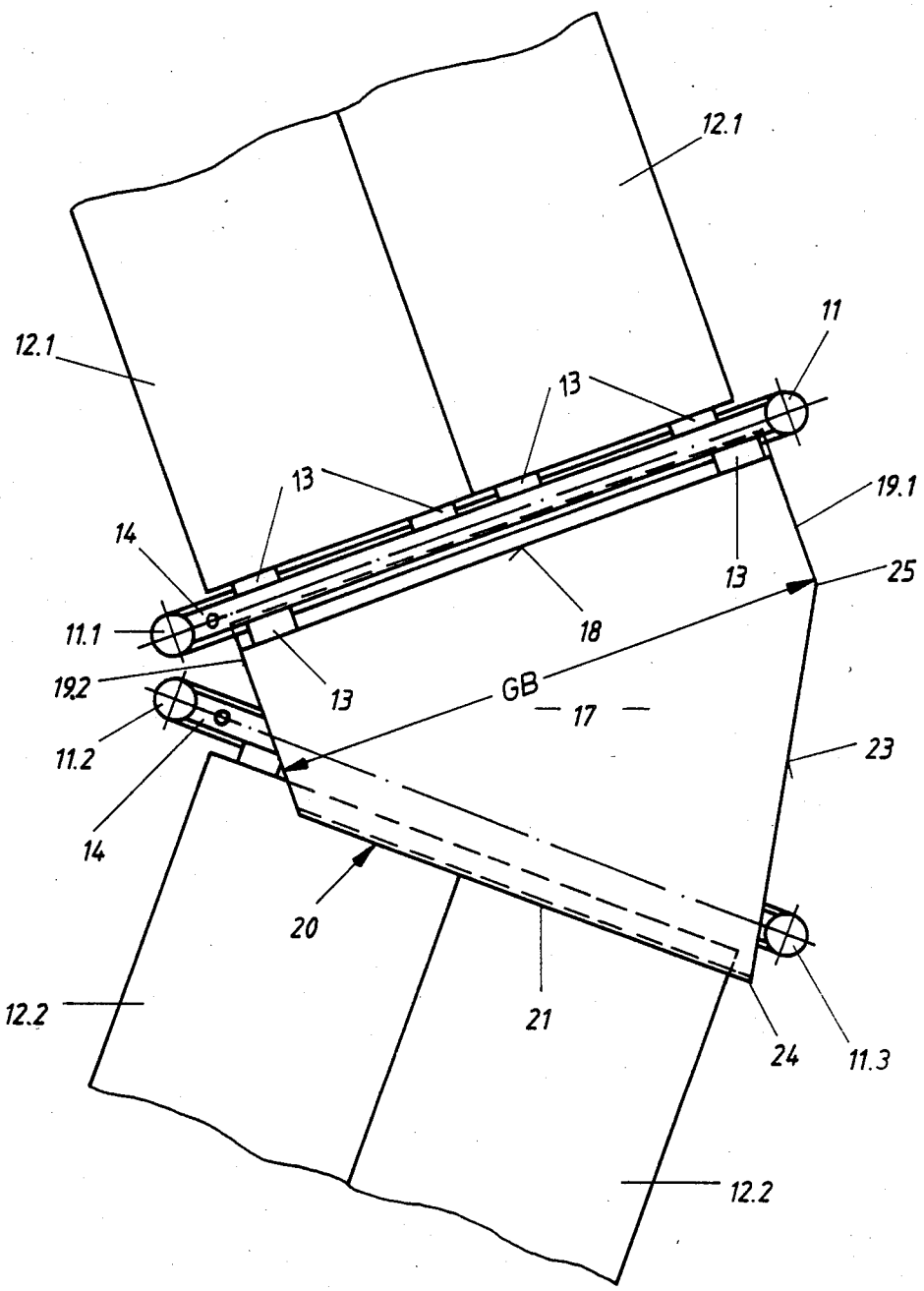
FIG. 2 is a top view of a simple corner platform section intended for a limited angular range.

In the embodiment of FIG. 2, a simple corner platform section 17, suited for bridging corner zones of up to 45°, is made of a uniform, slip-proof sheet-metal part and is cut to size in such a way that the corner platform section 17 includes, along a drop-in edge 18 thereof, the conventional width dimension GB of a customary scaffold platform panel width. In a first zone, the corner platform section 17 is defined along the side by lateral sections 19.1 and 19.2 adjoining at a right angle.

Figure 8:
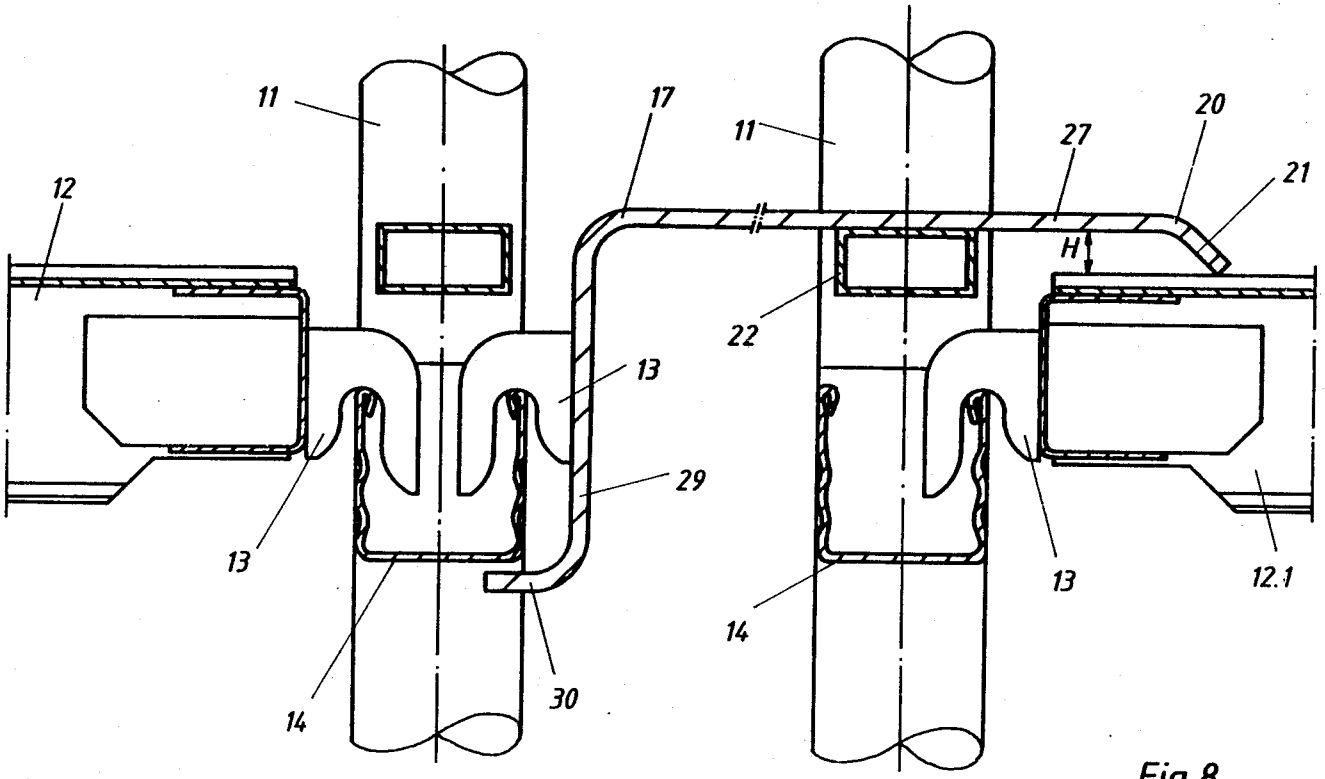
FIG. 8 is a vertical sectional view taken along bent line 8—8 in FIG. 7, depicting the bridging of a cross strut.

The lateral section 19.2 has such a length between adjacent posts 11.1, 11.2 that the lateral section 19.2 still extends to the scaffold platform 12.2. At that location, the lateral section 19.2 has a supporting edge generally designated by the reference numeral 20 cut at an angle of 45°. The supporting edge, as shown most clearly in FIG. 8, is provided with an obliquely downwardly beveled marginal leg 21 resulting in a free spacing H at the bottom, so that the corner platform section 17 lies above the lower transverse connecting tube 22 of the posts 11 of a frame once the lateral section 19.2 has been suspended in place.

The fourth boundary edge 23 (FIG. 2) extends from an outer corner point 24 of the supporting edge 20 to a corner point 25 of the lateral section 19.1. In this arrangement, the position is chosen so that the post 11.3 is not impeded by the boundary edge even in different swiveling positions, when the angles become smaller. Thus, relatively large angles, as well as minimally small angles can be readily bridged by means of a simple sheet-metal part that has been suitably cut to size and is somewhat beveled. The outer rims formed by the lateral section 19.1 and by the boundary edge 23 can be provided with an upwardly projecting, beveled leg (not shown) functioning as an edge board to prevent lateral slippage.

Figure 3:
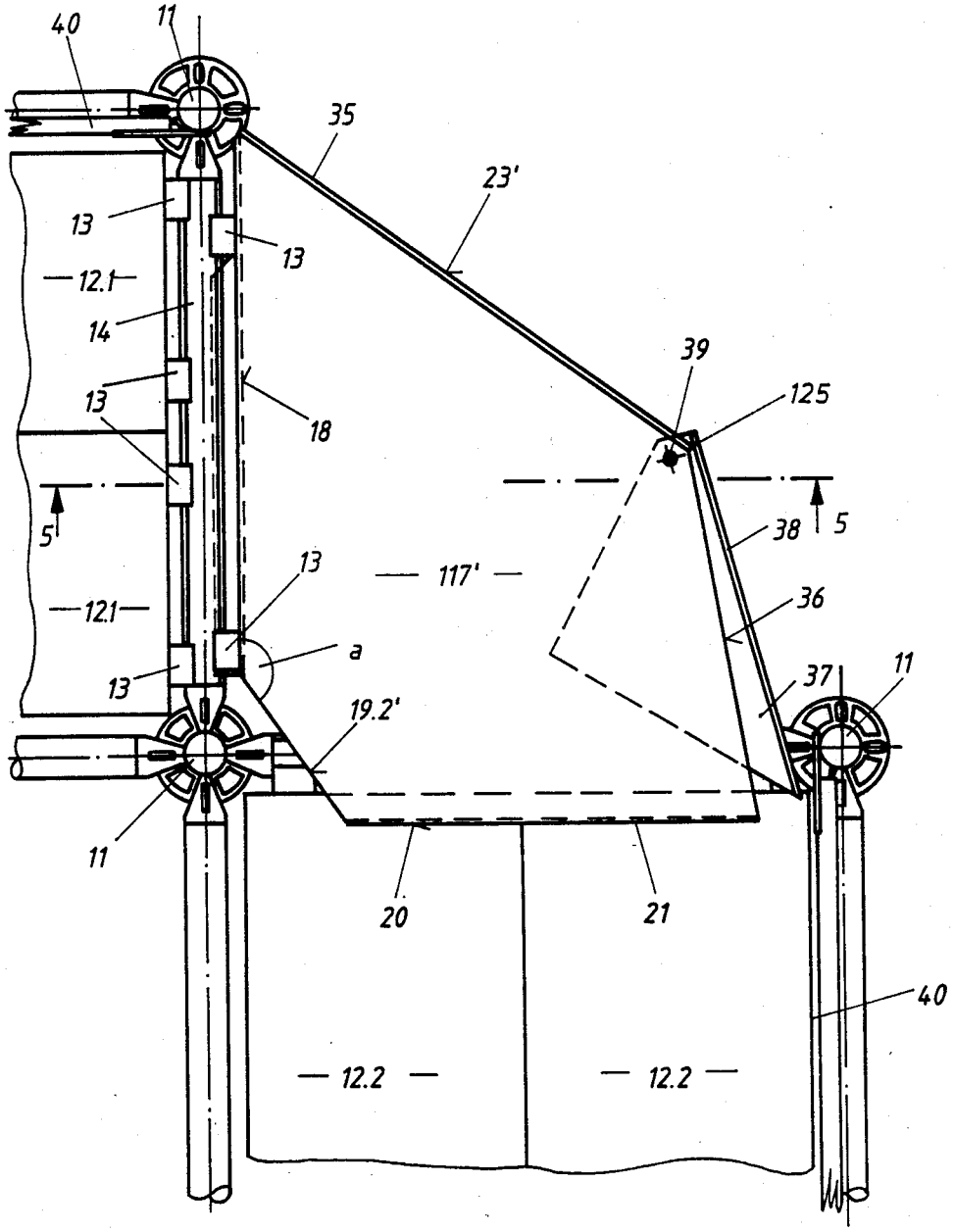
FIG. 3 is a top view of a further embodiment of a corner platform section permitting the bridging of angular ranges of up to 90°, at a 90° angle.
Figure 4:
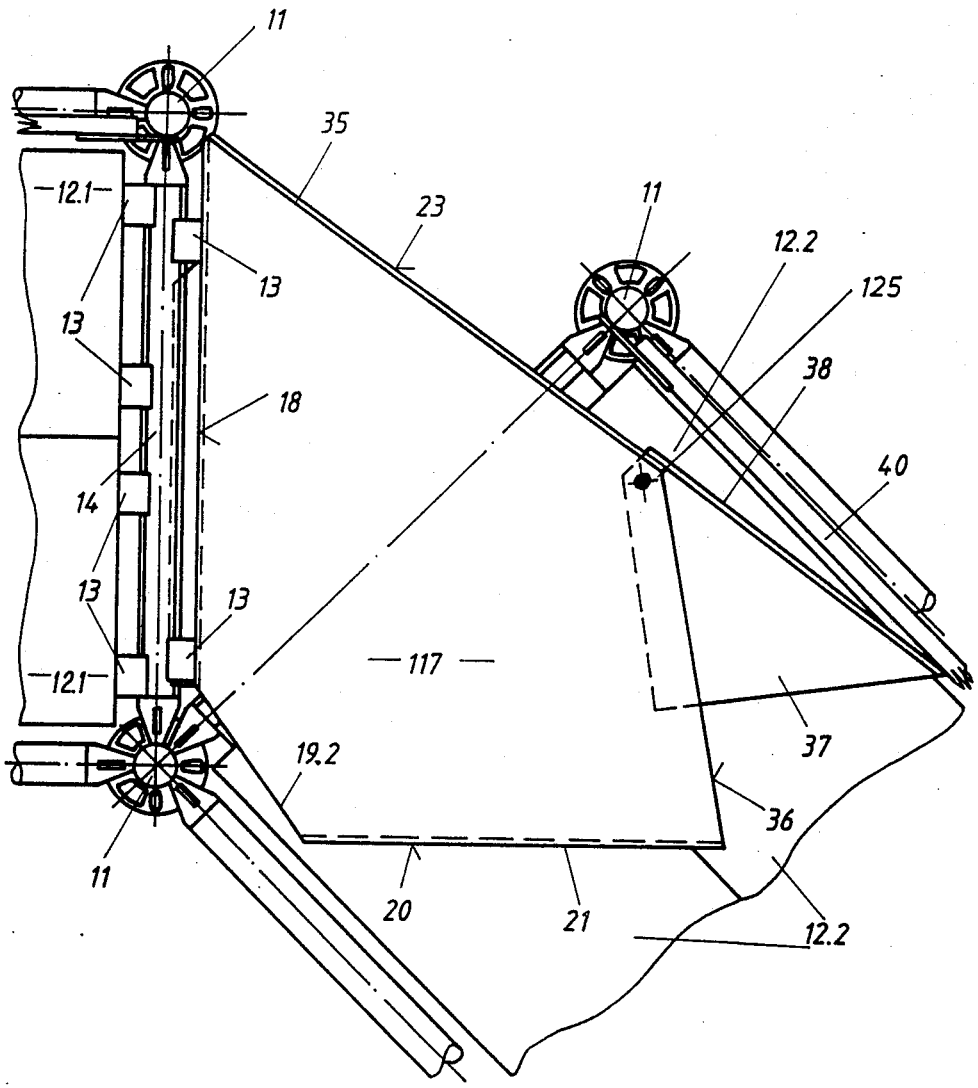
FIG. 4 is a top view of the corner platform section corresponding to FIG. 3, but in a swung-out position for a 45° angle.
Figure 5:
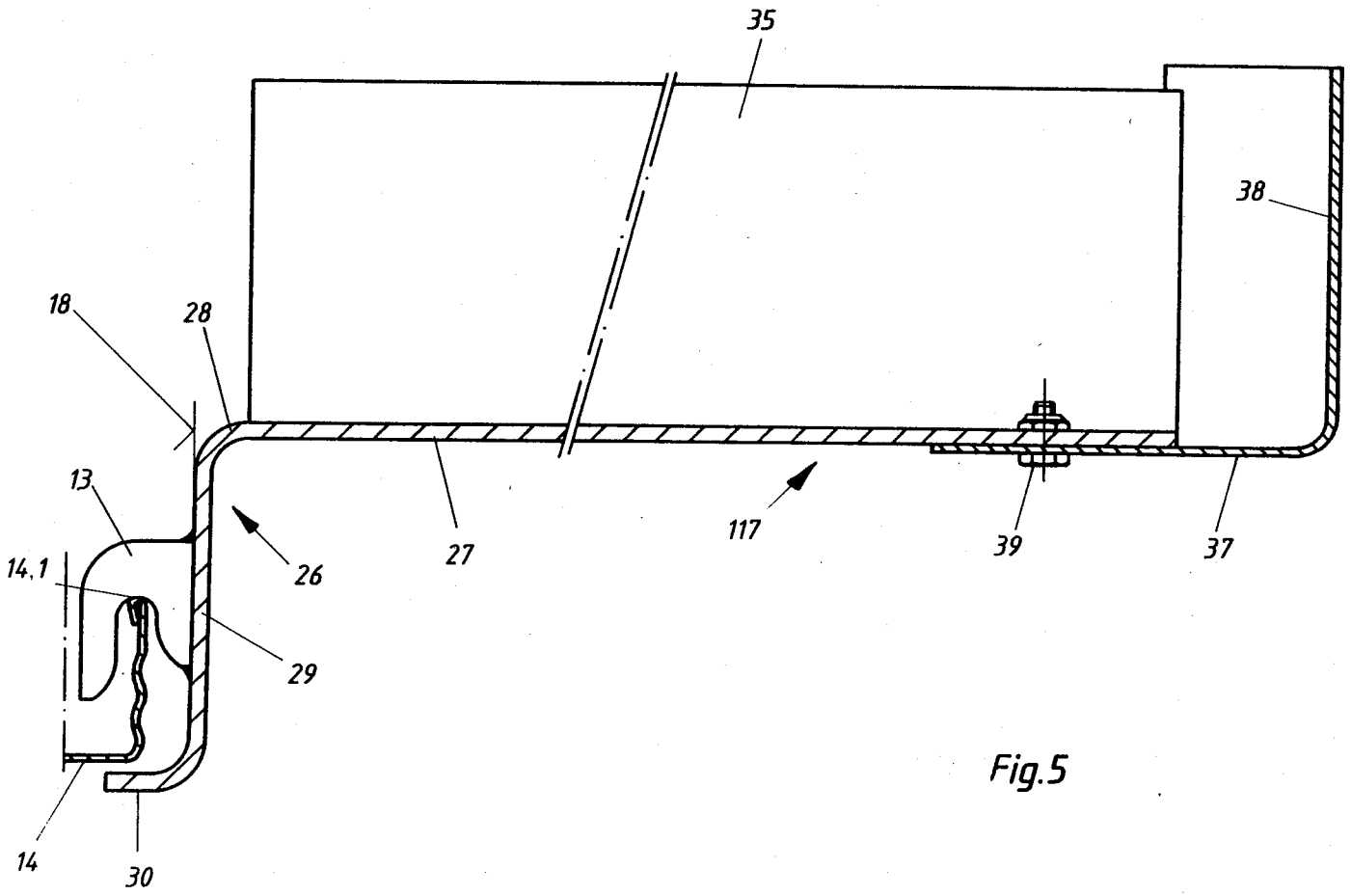
FIG. 5 is a horizontal partial section taken along line 5—5 in FIG. 3, the scaffold elements having been omitted.

As shown in FIG. 5, the a corner platform section 117 may include a drop-in zone generally designated by the reference numeral 26 and include a platform plate 27 having a thickness of, for example, 3–5 mm. The drop-in zone 26 is provided at a rim 28 forming the drop-in edge 18 with a supporting leg 29 bent downwardly at a right angle. Drop-in claws 13 are welded in place forwardly of the supporting leg 29 at an end face thereof, with the drop-in claws 13 being adapted to rest on upper, rounded edges 14.1 of the U-shaped supporting span members 14. The supporting leg 29 has such a length that it exhibits at the bottom an outwardly projecting, being again bent into the horizontal, outwardly projecting lift-preventing leg 30, with a position and length of the lift-preventing leg 30 being dimensioned to that the lift-preventing leg 30 lies, when dropped in obliquely from the top, in its final horizontal position by several millimeters below the bottom edge of the upwardly open U-shaped supporting span member 14, as shown in FIG. 5 thereby preventing corner platform section 117 from tipping. Like arrangements are provided on all corner platform sections to permit dropping in and to prevent lifting off and tipping. In contrast to the corner platform section 17 according to FIG. 2, the corner platform section 117′ of FIGS. 3 and 4 has a somewhat different contour line and is suitable for bridging larger angles of up to 90° while nevertheless permitting bridging of small angular ranges. In the arrangement of FIGS. 3 and 4, a lateral section 19.2′ is positioned at an angle a of 135° so that the lateral section 19.2′ extends, in case of all scaffolds under consideration, just barely beyond the support posts 11, even if two support posts are standing side-by-side. The supporting edge 20 with its edge leg 21 here extends with respect to the drop-in edge 18 at an angle of 90° and is arranged to be positioned farther outwardly so that this edge 20 rests on the scaffold platform 12.2 lying around the corner.

Furthermore, a boundary edge 23′ is here ex-tended in a straight line at a precise angle of 45° so that an outermost corner point 125 is located in such a way that the associated supports 11, together with their attachments lying in the corresponding plane, can just barely be swung past. The boundary edge 23′ is provided with an upwardly bent border leg 35 of the type of an edge board and, in a zone of the boundary edge 23, provided with border legs 35, is followed, without border legs, by a linear section 36 swung further inwardly and associated with a pivotable member 37. The pivotable member 37 permits, as shown in FIGS. 3 and 4, a varying angular position for an optimum bridging of the remainder of the marginal zone because, for example, in case of angular positions of merely 45° according to FIG. 4, the linear section 36 lies centrally on the surface. The pivotable member 37 has an upwardly projecting border leg 38 and is articulated, lying therebelow, with the aid of a continuously extending joint 39, to the floor plate 27, as shown in FIGS. 3–5.

Figure 6:
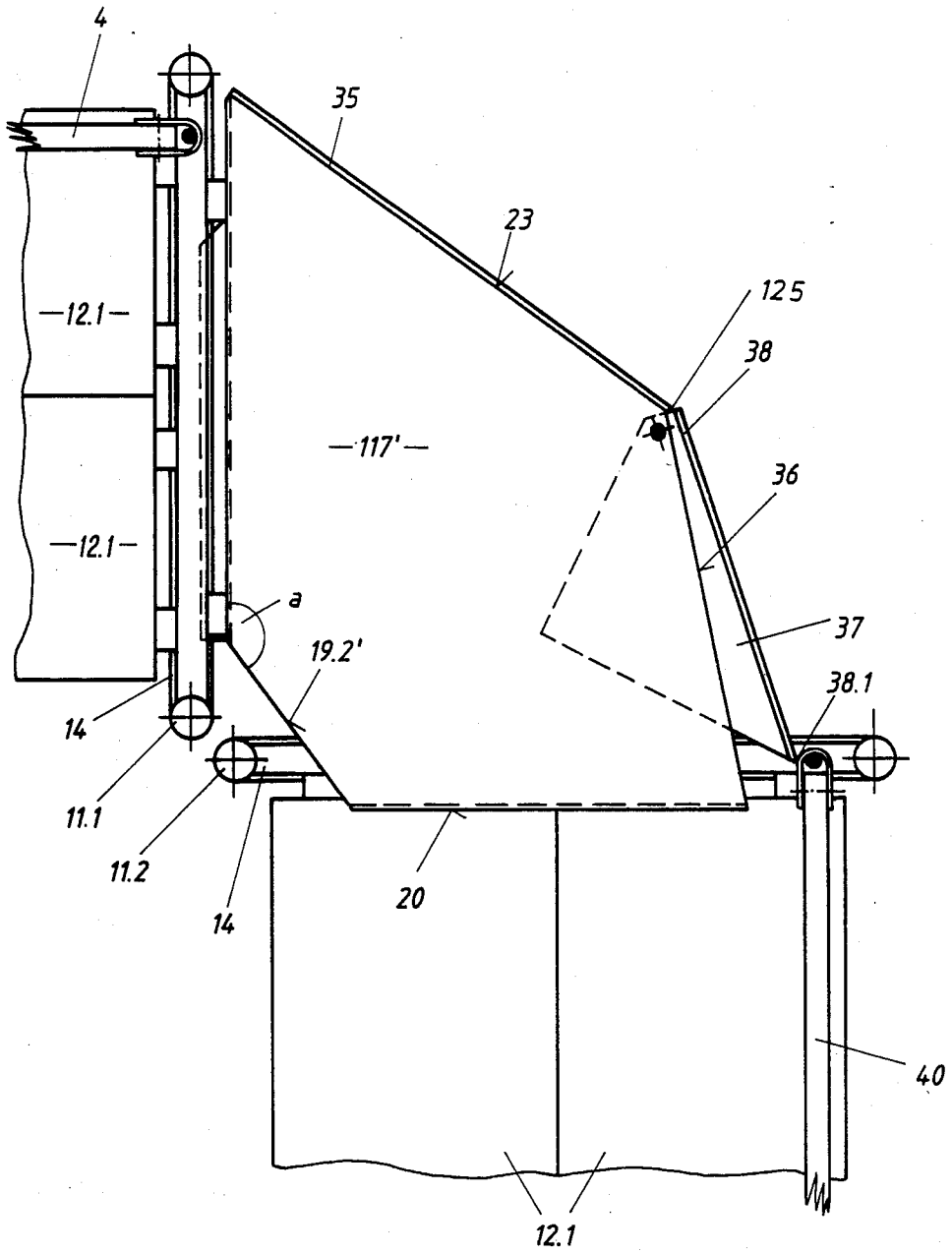
FIG. 6 is a top view the corner platform section depicted in FIG. 3–5, but for a frame scaffold.
Figure 7:
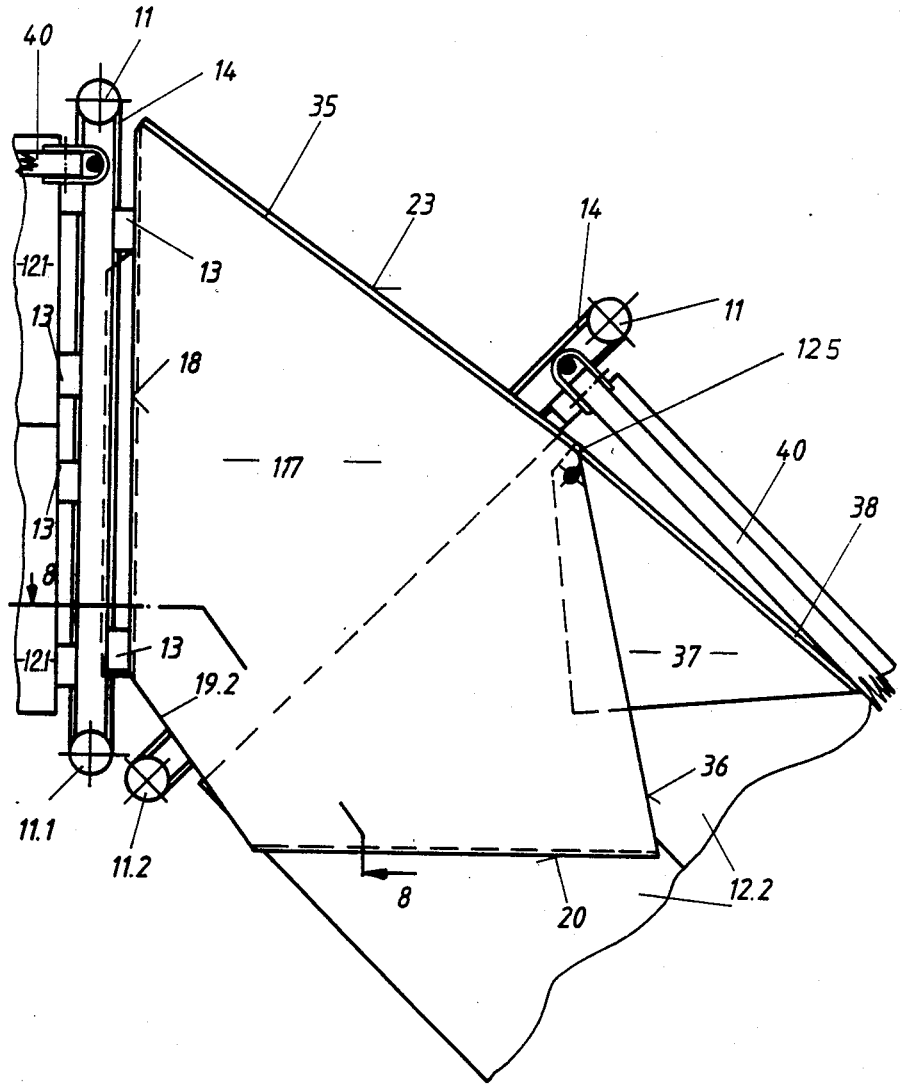
FIG. 7 is a top view corresponding to FIGS. 4 and 6 with the corner platform section at a 45° corner of a frame scaffold.

In the embodiment of FIGS. 6 and 7, frame scaffolds are provided having respectively two posts 11.1 and 11.2, as in FIG. 2. However, the structure, position, and function are identical, and the two usage positions at 45° and at 90° are illustrated with the respective swivel position of the pivotable member 37, where it can be seen even more clearly how the border leg 38 adjoins with its end 38.1 the actual edge board 40 of the primary scaffold.

Figure 9:
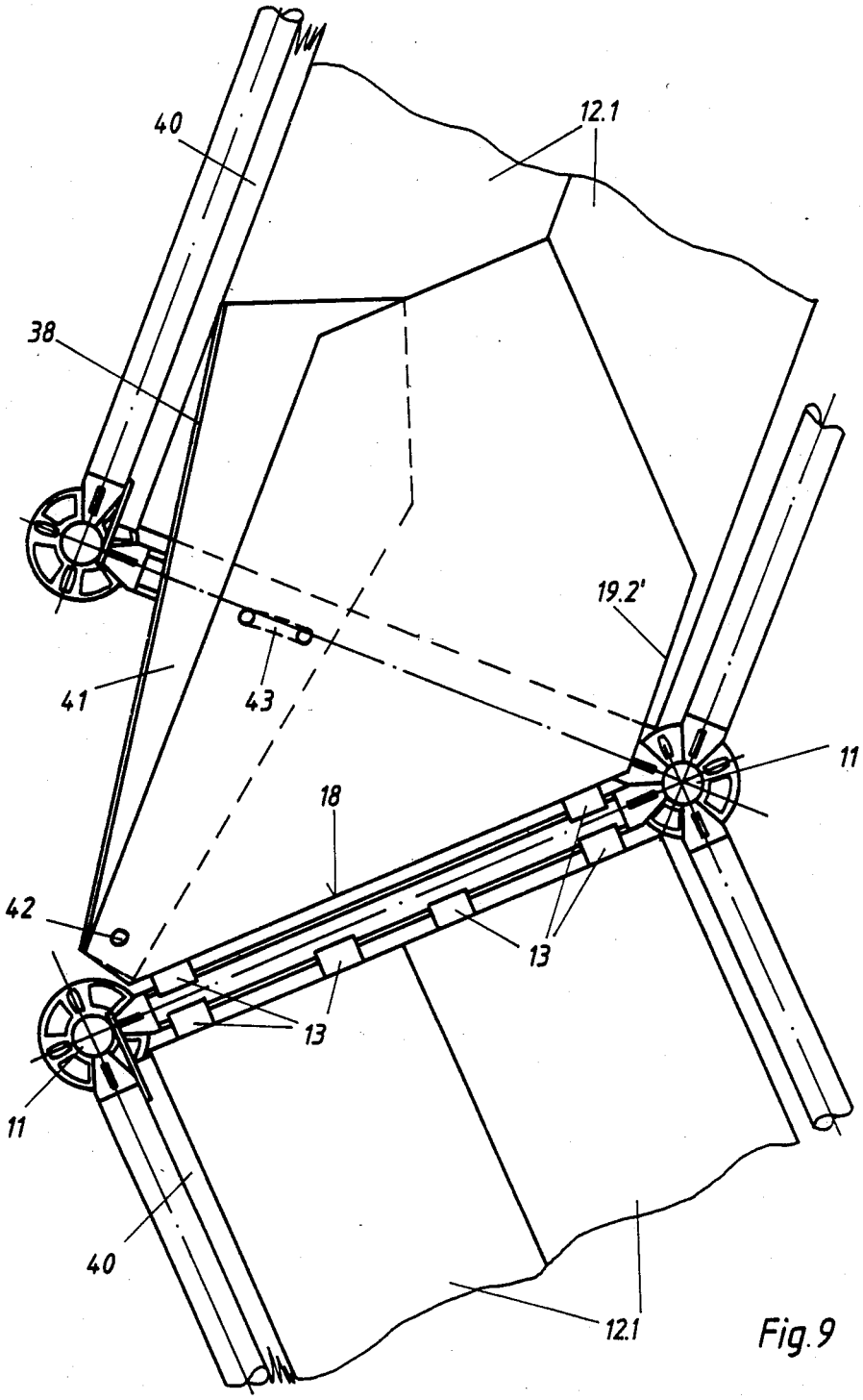
FIG. 9 is a schematic top view of a further embodiment with a differently arranged folding member.

In FIG. 9 a version similar to FIGS. 3 and 4, a pivotable member 41 has a greater length and lies with a point of articulation 42 directly at the outer corner of the drop-in edge 18. A sliding joint 43 with a slotted hole having the shape of a divided circle secures the connection. For certain constructions and angular ranges, such a solution may be expedient.

A scaffold corner platform section generally designated by the reference numeral 47 in FIGS. 10–14 differs from the scaffold corner platform section described hereinabove in that the scaffold corner platform section 47 is composed of two circular 12 segments or components 50.1, 50.2 of sheet metal superimposed in an overlapping zone 49, with the two circular segments or components 50.1 and 50.2 respectively having an externally located drop-in edge 48.1, 48.2 and supporting legs 29, 29.2. Both supporting legs 29, 29.2 have drop-in claws 13 fitting with the scaffold system and mounted in a suitable arrangement. The supporting leg 29 of the larger component 50.1 includes a lift-preventing leg 30 and is suspended in place in the same manner as described hereinabove. The supporting leg 29.2 is constructed without lift-preventing legs so that the corner platform section 47 can be swung or pivoted inwardly in a manner described hereinabove and can rest on both sides on the drop-in claws 13 on the edges 14.1 of the U-shaped supporting span members 14.

Figure 10:
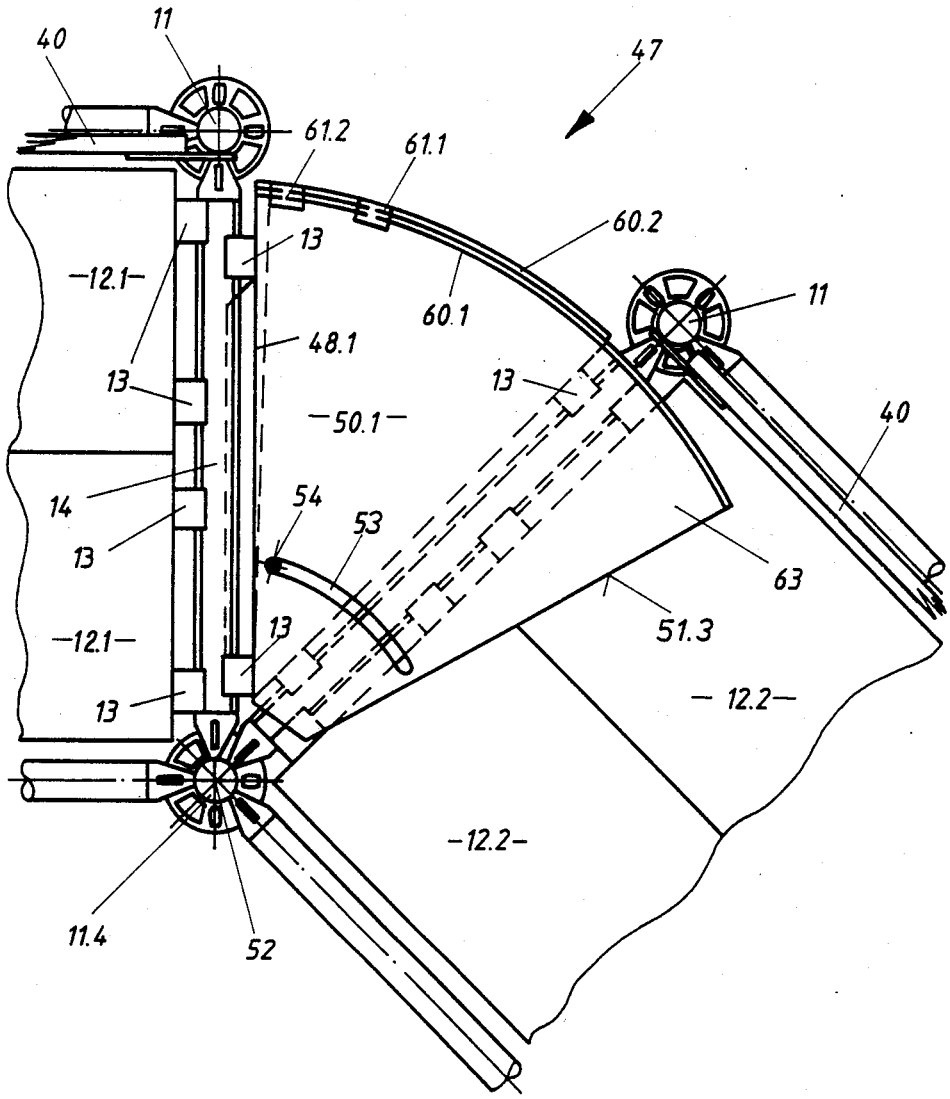
FIG. 10 is a top view of a further embodiment for a corner platform section with adjoining elements at the smallest possible angle.
Figure 11:
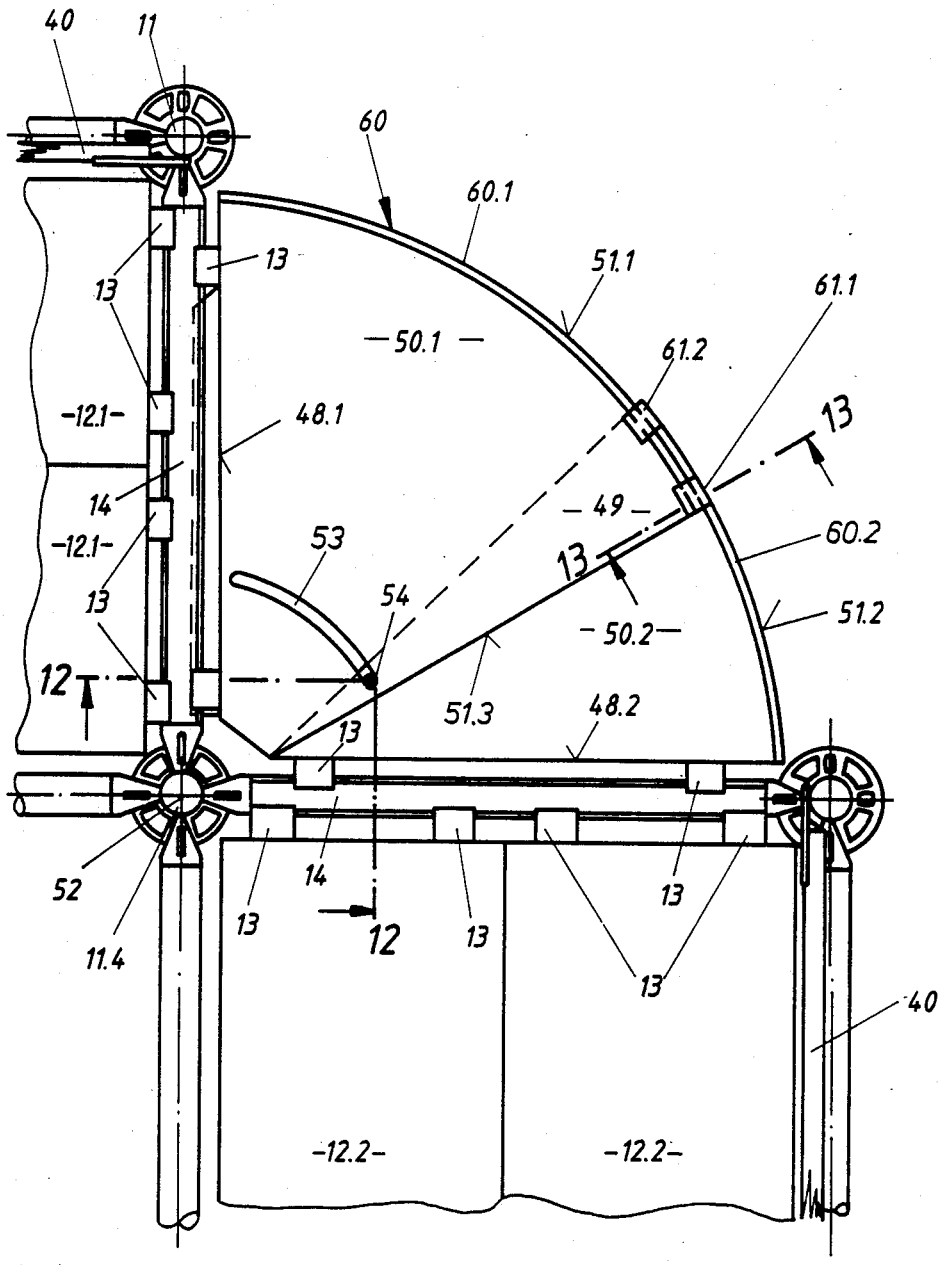
FIG. 11 is a top view corresponding to FIG. 10 at the largest possible angle.
Figure 12:
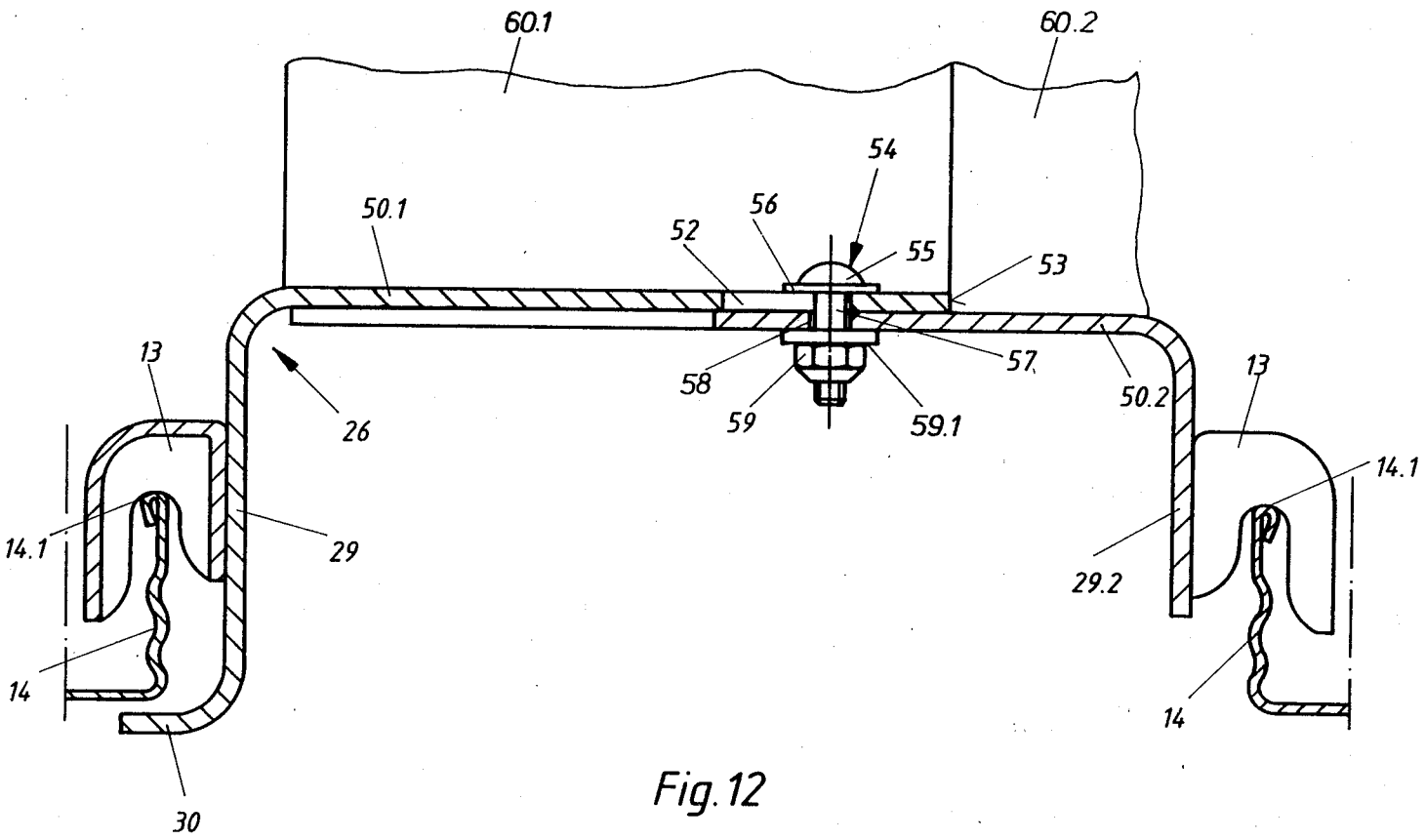
FIG. 12 is a partial vertical section taken along the bent line 12—12 in FIG. 11 on a larger, approximately natural scale.

The two circular segments or components 50.1, 50.2 each terminate in an outer boundary 51.1, 51.2 extending in the shape of a divided circle, with a center of the divided circles being a center 52 of the corner supporting post 11.4 as shown most clearly in FIGS. 10 and 11. In this scaffolding, the pivoting action when setting up at non-linear facades or the like takes place in each case about the center 52 of the supporting post 11.4 between two scaffold panels and thereby the corner arrangement is built up so that the corner platform section 47 can be fittingly suspended in place.

When employing scaffoldings wherein two supporting posts, or the posts of two frames, are in close juxtaposition, a suitable center in their proximity is to be defined for fashioning the corner platform section. Concentrically to the center 52, a slotted hole 53 having the shape of a divided circle extends in the component 50.1, with the slotted hole 53 extending to approximately the drop-in edge 48.1 and approximately the internal boundary 51.3 as shown most clearly in FIGS. 10 and 11.

A retaining pin generally designated by the reference numeral 54 passes through the slotted hole 53, with the slotted hole 53 being curved in the manner of a partial circle. A rounded head 55 of the retaining pin 54 rests, through the interposition of an adequately large washer 56, above rims of the slotted hole 53 on a surface of the circular segment or component 50.1. A simple through hole or passage 58 is arranged in the sheet metal of the other circular segment or component 50.2 lying there below. A shank 57 of the retaining pin 54 extends through the through hole or passage 58, with the entire arrangement being mounted on an underside with a washer 59.1 firmly braced against a shoulder and with a nut 59. By virtue of this arrangement, a flexurally rigid connection is obtained between the two circular segments or components 50.1 and 50.01 in the inner end zone of the corner platform section 47 which can nevertheless be pivoted about the center 52 through an arc.

Figure 13:
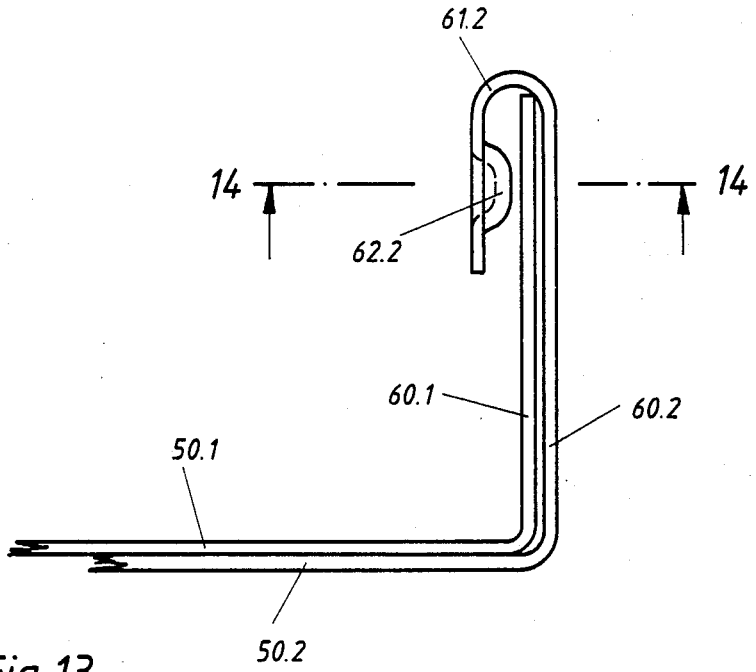
FIG. 13 is a partial vertical section taken along the line 13—13 in FIG. 11 through the guiding border legs.
Figure 14:
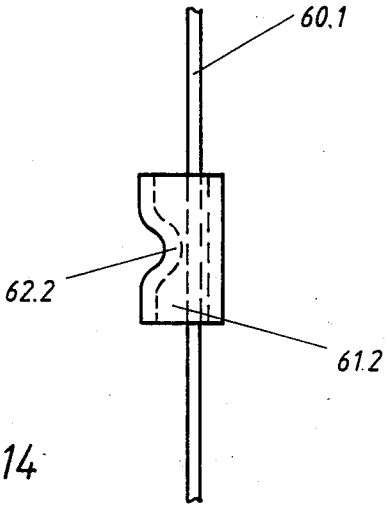
FIG. 14 is a partial horizontal section taken along line 14—14 in FIG. 13.

The external, slidable and flexurally rigid connection is formed together with a border leg generally designated by the reference numeral 60 of the corner platform section 47. For this purpose, border legs 60.1 and 60.2, respectively, are formed, projecting upwardly, at both components 50.1 and 50.2 in the external zone, of a height corresponding to the remaining scaffolding and safety; as is also shown in FIGS. 13 and 14. In this arrangement, the component 50.2 lying at the bottom is provided with an externally located border leg 60.2 equipped at the top with overlapping legs 61.1 and 61.2 holding the sliding joint together and extending to the inside of the inwardly located border leg 60.1 from above. In order to obtain a readily operable sliding joint, supporting nubs 62.2 are embossed which project from the surface toward the border leg 60.1 so that two point-like contact sites are produced. The two overlapping legs 61.1 and 61.2 lie at a small angular spacing, as shown especially in FIG. 11, so that they both still engage securely at the border leg 60.1 even in the smallest overlapping range 49. If the corner platform section 47 is further swiveled together due to a larger or smaller angle between the scaffold panels, as is possible up to the final position illustrated in FIG. 10, then the supporting nubs 62.2 are entirely within the neighboring zone of the drop-in edge 48.1. In this position, the component 50.1 located on top is swung so far over the component 50.2 that its outer end 63 comes to lie above the scaffold platforms 12.2 of the adjoining panel, as shown in FIG. 10.

This arrangement, which seems somewhat more 5 complicated in structure, provides readily surveyable supporting conditions, but requires a firm, flexurally rigid connection among the components which is safely slidable over a long period of time so that this connection can meet the needs in the rough realm of the 10 building trade over many years. For this reason, the arrangement does not employ the principle of support on the neighboring scaffold platform. This arrangement displays a clear edge board boundary which in all cases extends past the linear corner railing and always has a border leg arrangement which is continuous over the entire length.

Figure 15:
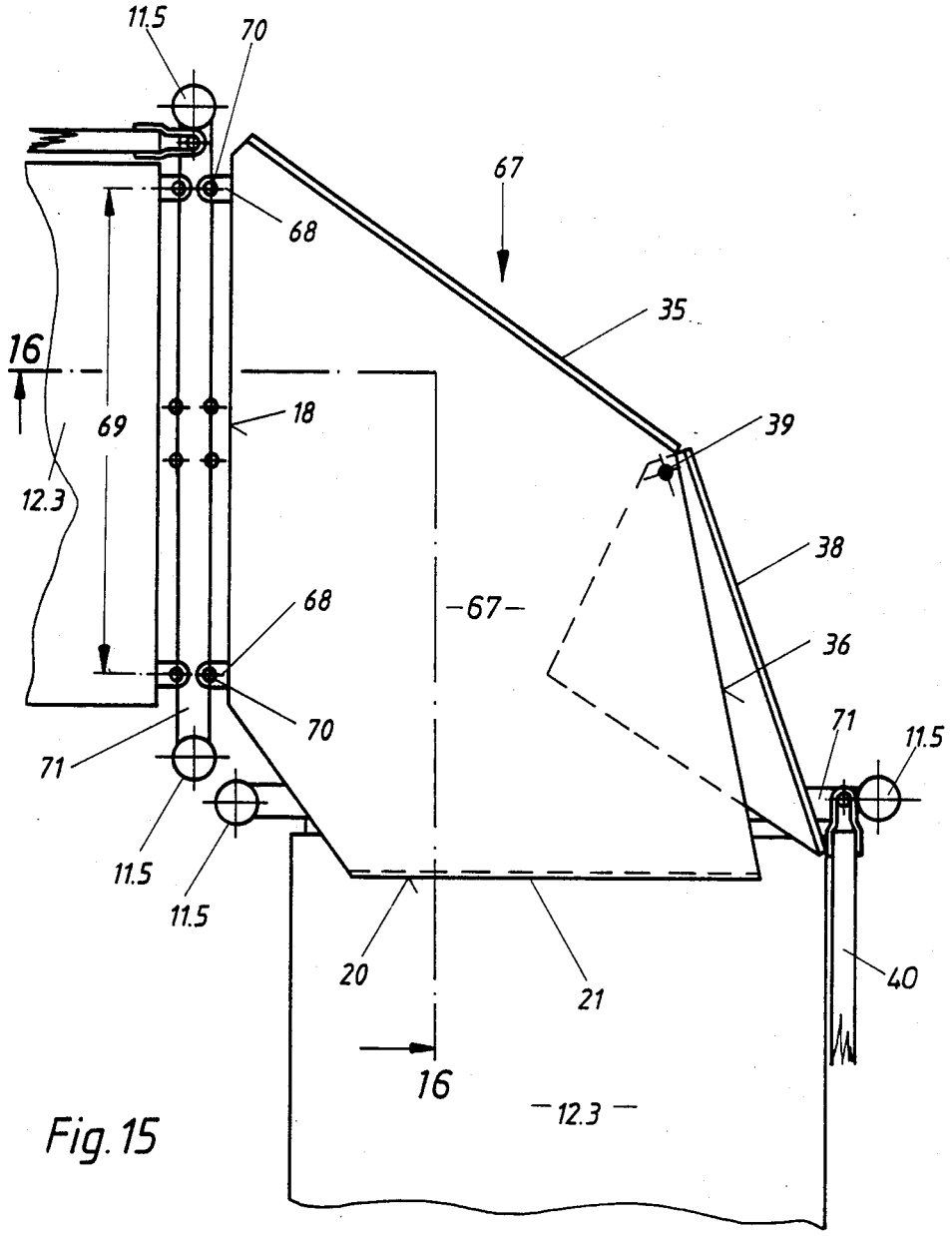
FIG. 15 is a top view of another embodiment of a corner platform section as essentially shown in FIG. 3, but having different drop-in means.
Figure 16:
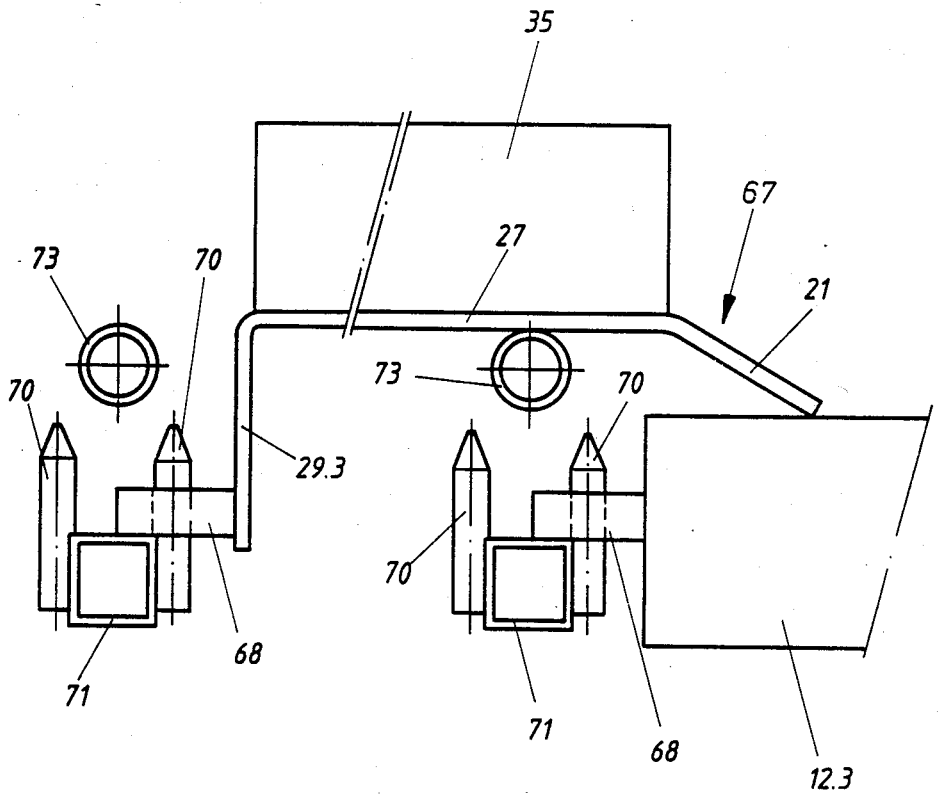
FIG. 16 is a horizontal partial section taken along the bent line 16—16 in FIG. 15, depicting an insert pin drop-in system for corner platform sections.

In the embodiment of FIGS. 15 and 16 shows a corner platform section generally designated by the reference numeral 67 essentially corresponds to the corner platform section 117 of FIG. 6 with respect to its configuration; however, in place of the drop-in claws 13 of the embodiment of FIG. 6, this arrangement includes drop-in eyes 68 mounted at a spacing 69 to the supporting leg 29.3 of the corner platform section 67 along one edge, as is customary, for example, by welding, screws, or by rivets.

The drop-in eyes 68 have vertical passage bores engaged by vertical retaining pins 70 fastened by, for example, welding on the outside to the supporting cross-pieces 71 at a suitable spacing. The supporting cross-pieces 71 are attached to posts 11.5 of a scaffold support in the neighboring panel, this support being fashioned, for example, in the shape of a frame. Also the remaining scaffold platforms are mounted to retaining pins 70 by drop-in eyes.

This type of mounting is provided for the corner platform section generally designated by the reference numeral 67 only on one drop-in edge. Such mounting can also be provided identically at the second drop-in edge in a corner platform section having the configuration according to FIGS. 10–14. As shown in FIG. 16, the scaffold floor 12.3 is retained by identical drop-in eyes 68. A round, horizontally extending cross connection tube 73 pertains to the supporting structure of the scaffold and usually establishes the connection of the posts in their lower region for the formation of frames. The cross connection tube 73 serves simultaneously as a securing means against lifting off. The bottom plate 27 of the corner platform section 67 extends, exactly as has been described in connection with FIG. 8, over this cross connection tube 73. The other embodiments of corner platform sections can likewise be equipped with like drop-in eyes or other connecting means for the respective scaffolding.

The connecting means or suspension means for connecting the corner platform part with the supporting span members 14 or the like can also have other shapes and can be designed as differently shaped hooks or eyes or as beads, prisms, or other drop-in shapes. They can also be designed as double claws, double hooks, double beads, or double prisms or the like as are usually employed for scaffold systems and which correspond to the receiving area and the cooperating fastening means, which ensure that the applied forces are supported and lifting up is prevented, for example, by transverse components, which after assembly are located so close to the suspension means that the latter can no longer be lifted out of the secured position of use.

Figure 17:
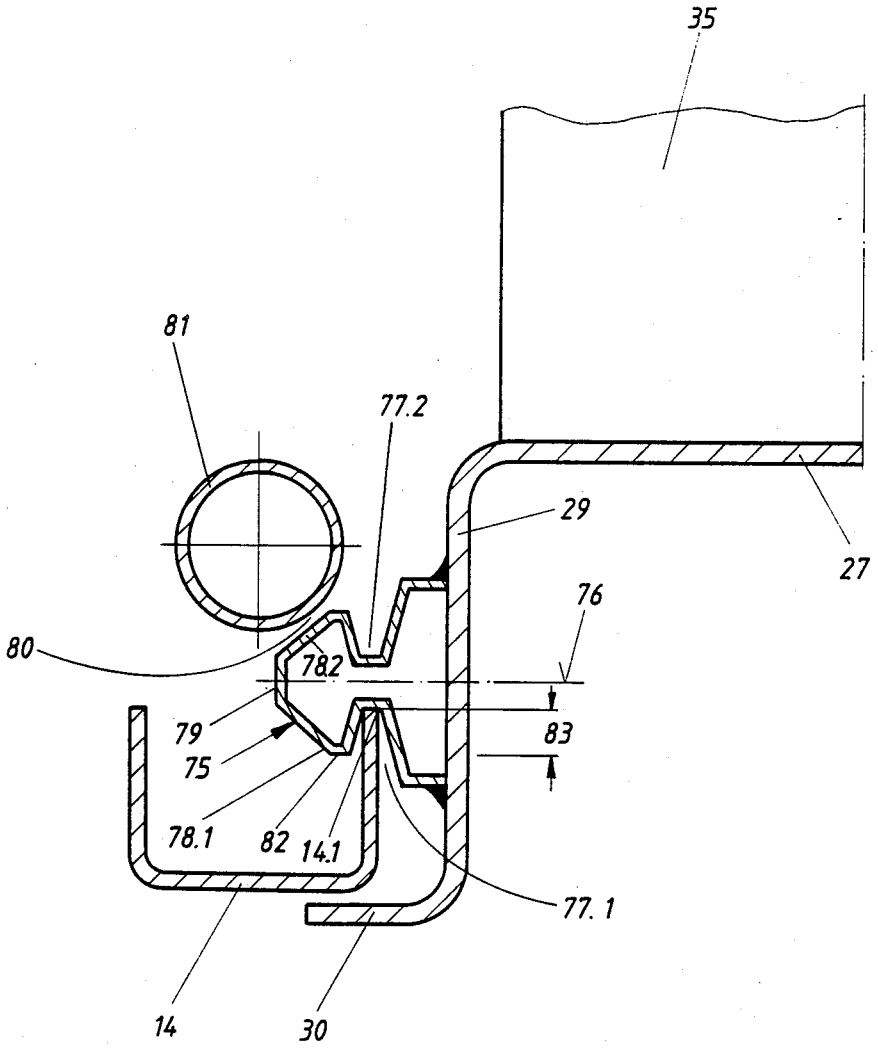
FIG. 17 is a horizontal partial section roughly corresponding to the left part of FIG. 16 but shows suspension means for suspension from a supporting span member, which are in the shape of a double prism or a double bead.

For example, as shown in FIG. 17, suspension double prisms generally designated by the reference numeral 75 can be fastened to supporting legs 29, with the prisms 75 being formed, for example, from a multiple bent sheet metal section. The suspension double prism 75 is designed to be symmetrical to horizontal center 76 and has on each side, a depression 77.1 or 77.2, with the depression 77.1 being designed as a suspension depression for resting on edge 14.1 of a U-shaped supporting span member 14.

Downwardly projecting securing part 78.1 has a roughly triangular shape, with a lower edge 82 thereof being located at a distance 83 below the edge 14.1 of the support span member 14. Outer limiting wall 79 is vertical and blends with an upper securing part 78.2 which is likewise roughly triangular in shape. Then, as shown in FIG. 17, only a small space 80 is left with respect to the transverse connecting tube 81, with the transverse connecting tube 81 lying between the posts (not shown) and preventing, as can be seen, the suspension double prism 75 from being lifted out of the locking position because space 80 is much smaller than the distance 83. The locking action also operates on the one side shown here of lift-preventing leg 30. As can be seen, corner platform parts of any of the embodiments mentioned can also be fitted with suspension means known of themselves, as in FIG. 17.

We claim:

1. A scaffolding arrangement for enabling a set-up of scaffolding in and around irregular shaped objects with non-parallel boundaries, the scaffolding arrangement including at least one scaffolding platform section extending in a first direction, at least one further scaffolding section extending in a second direction inclined with respect to the first direction such that a corner gap is formed between adjacent ends of the scaffolding platform sections, a corner platform means for bridging the corner gap including a floor plate means for defining a walking for working surface having drop-in means provided along at least one edge thereof for securing the floor plate means to a support means, with another edge thereof being adapted to being supported by resting on one of the scaffolding platform sections, and wherein an outer peripheral edge of the floor plate means extending between the edge provided with the drop-in means and the edge supported by resting on one of the scaffolding platform sections is one of linear, bent, or rounded in dependence upon a position of the adjoining scaffolding platform sections and support means thereof whereby the floor plate means maximally covers a corner angle defined by said corner gap.

2. A scaffolding arrangement according to claim 1, wherein the drop-in means includes claws fastened on and outside of a supporting leg means of said floor plate means, and said supporting leg means being substantially perpendicularly bent with respect to a plane of said floor plate means and including lift-preventing leg means at a lower end thereof bent outwardly into a horizontal plane and lying below a horizontally extending supporting span member of the support means.

3. A scaffolding arrangement according to one of claims 1 or 2, wherein the support means includes support posts joined to said scaffolding sections by transverse connection means, and wherein the corner platform means extends above the transverse connection means and includes at the edge adapted to be supported in the scaffolding platform sections marginal leg means bent away in a downward direction by a thickness of the transverse connection means.

4. A scaffolding arrangement according to one of claims 1 or 2, wherein the corner platform means further includes a pivotable member articulated so as to be pivotable beneath the floor plate means, and wherein a widest portion of said pivotable member is shaped correspondingly for pivoting over the corner gap.

5. A scaffolding arrangement according to one of claims 1 or 2, wherein the corner platform section includes an upwardly projecting border leg means along the outer peripheral edge of the floor plate means.

6. A scaffolding arrangement according to claim 4, wherein the pivotable member includes border leg means disposed along an outer peripheral edge thereof.

7. A scaffolding arrangement according to claim 6, wherein the outer peripheral edge of the floor plate means extends up to a corner point defining a central pivoting position of the floor plate means and the pivotable member with respect to each other, of about 45°, said floor plate means including a linear section extending from the corner point to the edge adapted to be supported by resting on one of the scaffolding platform sections in such a manner that the floor plate means leaves, in a 90° pivot position between the linear section and an outwardly located support post of the support means, a small vacant space for accommodating the border leg means of the pivotable member.

8. A scaffolding arrangement for enabling a set-up of scaffolding in and around irregular shaped objects with non-parallel boundaries, the scaffolding arrangement including at least one scaffolding platform section extending in a first direction, at least one further scaffolding section extending in a second direction inclined with respect to the first direction such that a corner gap is formed between adjacent ends of the scaffolding platform sections, a corner platform means for bridging the corner gap including two floor plate means for defining a walking or working surface each including drop-in means provided along at least one edge thereof for securing the respective floor plate means to a support means, said two floor plate means being disposed in a partially superimposed relationship and being joined so as to be mutually pivotable about a center point lying in a predetermined position in dependence upon a position of the adjoining scaffolding sections.

9. A scaffolding arrangement according to claim 8, wherein an outer peripheral edge of each of said two floor plate means is configured in the shape of a divided circle.

10. A scaffolding arrangement according to one of claims 8 or 9, wherein the outer peripheral edges of the respective floor plate means includes at least one mutually insertable guiding border leg means or at least one divided circle-slotted hole means for forming a sliding connection between said two floor plate means.

11. A scaffolding arrangement according to claim 10, wherein at least one guiding border leg means is formed with a shaped point-contact protuberance means on a portion of one of the floor plate means.

12. A scaffolding arrangement according to claim 10, wherein only one drop-in means includes a lift-preventing leg means for preventing a lifting of the floor plate means from the support means.

13. A scaffolding arrangement according to one of claims 1, 2, 8, or 9, wherein said drop-in means includes engaging means for enabling a safe connection with the support means.

14. A scaffolding arrangement according to claim 13, wherein the engaging means includes drop-in eye means for attachment of retaining pin means freely movable in an upward direction.

15. A scaffolding arrangement according to claim 14, wherein the drop-in eye means are attached to a downwardly angled vertical supporting leg means of the floor plate means.

16. A scaffolding arrangement according to claim 13, wherein the engaging means include at least one of beads, prisms, double claws, double hooks, double beads, or double prisms.

17. A scaffolding arrangement according to claim 13, wherein a space is provided between an upper portion of the engaging means and a transverse connecting means of the support means, said space is less than a height of an overlap of the engaging means on the support means.

* * * * *